US005456187A

United States Patent [19]

Polley et al.

[11] Patent Number: 5,456,187

[45] Date of Patent: Oct. 10, 1995

[54] RAILROAD TRUCK AXLE ASSEMBLY RETENTION MECHANISM

[75] Inventors: Richard B. Polley; Anthony L. Richkas, both of Gahanna, Ohio

[73] Assignee: G.S.I. Engineering, Inc., Columbus, Ohio

[21] Appl. No.: 189,730

[22] Filed: Feb. 1, 1994

[51] Int. Cl.[6] ..... B61F 5/26

[52] U.S. Cl. ..... 105/217; 105/218.1

[58] Field of Search ..... 105/217, 218.1, 105/220, 463.1; 182/171, 207, 208, 290

[56] References Cited

U.S. PATENT DOCUMENTS

| | | | |
|---|---|---|---|
| 1,024,456 | 4/1912 | Pope | 105/217 |
| 2,522,626 | 9/1950 | Lyles | 105/217 |
| 3,785,297 | 1/1974 | Barnard et al. | 105/217 X |
| 4,867,269 | 9/1989 | Lalikos et al. | 181/207 |
| 5,233,832 | 8/1993 | Moore | 181/240 X |

*Primary Examiner*—Robert J. Oberleitner
*Assistant Examiner*—S. Joseph Morano
*Attorney, Agent, or Firm*—Banner & Allegretti, Ltd.

[57] ABSTRACT

A railway car truck axle assembly retention mechanism for retaining an axle assembly when the truck frame is lifted for maintenance purposes, including a connecting member having a plurality of upright flat metal plates fastened together in face-to-face relation and having the lower end of the plates secured to an axlebox, the upper end of the plates being free of the frame when operating on rail but being engageable to be lifted by the frame when the frame is lifted for maintenance purposes.

10 Claims, 1 Drawing Sheet

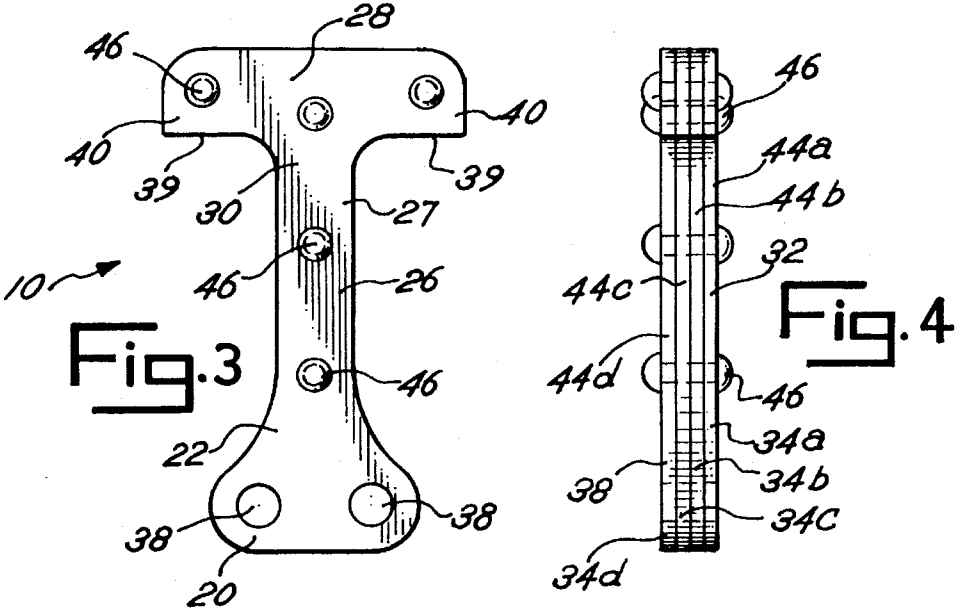
Fig. 4
Fig. 3
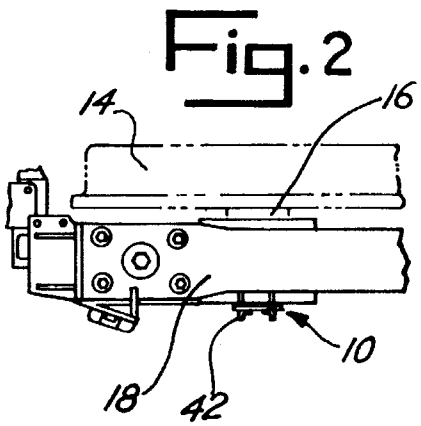
Fig. 2
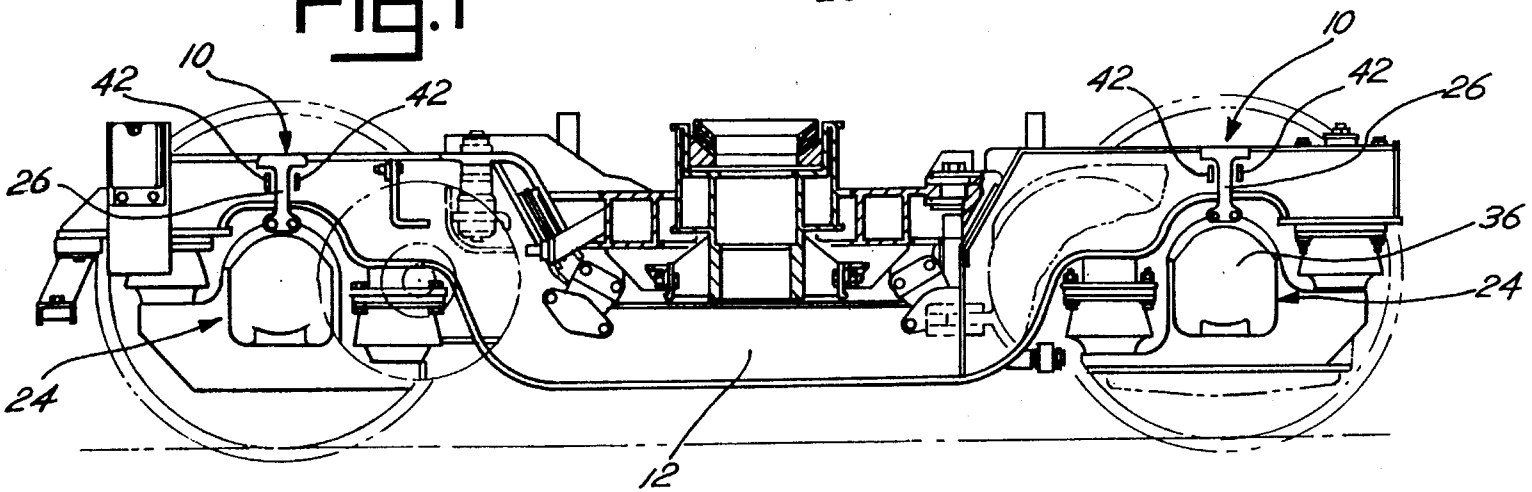
Fig. 1

RAILROAD TRUCK AXLE ASSEMBLY RETENTION MECHANISM

The present invention relates to apparatus for use in connection with railroad rolling stock in general, and to an improved railroad truck axle assembly retention mechanism of the kind which may be connected to an axle box, in particular.

In the prior art, devices (called "safety" devices) have been utilized to retain the axle assembly when the truck frame of a railway truck has been elevated, such as for example to perform maintenance on the railway truck. Such safety devices have been typically connected to the axle box of the railway truck, for greatest convenience.

In the prior art, four axle box safeties have usually been utilized per truck—one at each of the four axle boxes. Such axle box safeties have most frequently been bolted to the axle boxes. These axle box safeties have usually been formed from heavy steel plate, most frequently have been cut in a T-shape, and have included various types of apparatus thereon for fastening to the axle box. These prior art structures have in general been of ample strength to withstand the maximum dead weight load imposed by the weight of the axle assembly while the axle assembly is suspended by the axle box safeties during maintenance operations. However, these otherwise satisfactory prior art axle box safeties have failed prematurely in running service under no load conditions. It is believed that the cause of this failure phenomenon has been occasioned by the vibrations which are transmitted from the rail to the axle box safety. These vibrations have included a wide spectrum of frequencies. It appears that these vibrations serve to excite the resonance frequency of the axle box safety—much like a tuning fork, to vibrate continuously and thereby fail the axle box safety in fatigue. Thus, vibrations by the above mechanism are believed to result in premature failure of the axle box safety.

Based upon the above defects, deficiencies and disadvantages of prior art axle box safeties, it is the material object of the present invention to overcome such shortcomings of prior art devices and to provide an improved axle assembly retention mechanism.

It is also the material object of the present invention to replace the single, heavy steel plate of prior art axle assembly retention mechanisms with multiple steel plates which are securely and permanently fastened together by rivets or other suitable fasteners.

It is an additional material object of the axle assembly retention mechanism of the present invention to provide a lamination of relatively thinner metal plates, which when exposed to the rail-generated frequency spectrum, vibrations which would otherwise result are immediately damped between the multiple laminations, thereby to negate any resonance which might otherwise result. Such damping of vibrations in the improved axle assembly retention mechanism of the present invention prevents premature failure in service under the no-load condition, described supra, and allows for a considerably augmented service life.

These and other objects of the improved axle assembly retention mechanism of the present invention will become apparent to those of ordinary skill in the art upon review of the following summary of the invention, brief description of the drawing, detailed description preferred embodiments, appended claims and accompanying drawings.

SUMMARY OF THE INVENTION

The axle assembly retention mechanism of the present invention is directed to improved means for retaining the wheels and axle of a railroad truck together with the railroad truck frame when the frame is elevated above the resting position, such as for example may occur during maintenance operations. The axle assembly retention mechanism hereof may in some preferred embodiments be connected to the axle box.

Such axle assembly retention mechanism includes a connector means, which is disposed at the proximal end thereof for operative connection to the axle assembly. The axle assembly retention means includes a shaft which extends upwardly from the connector means, and such shaft has a frame engagement surface disposed at the distal end of the shaft for connection to the frame during elevation operations.

The overall shape of the axle assembly retention mechanism in preferred embodiments is T-shaped.

The improvement of the present invention is directed to the formation of at least the shaft portion of the axle assembly retention mechanism (and preferably the entirety thereof) from at least two laminations (and preferably additional laminations) of metallic (and preferably steel) sheet material.

The laminations of the axle assembly retention mechanism of the present invention function to damp out the vibrations which excite the resonant frequency of each of the laminations, resulting in greatly reduced resonance, if any, thereby to prevent premature failure.

BRIEF DESCRIPTION OF THE DRAWING

The improved axle assembly retention mechanism of the present invention is to depicted in the accompanying drawing, and in which:

FIG. 1 is a schematic side view of a railroad truck showing the axle assembly retention mechanism thereof connected to the axle box;

FIG. 2 is a schematic top view of a railroad truck showing the means of connection between the axle box assembly retention mechanism and the axle box;

FIG. 3 is a greatly enlarged side view of the improved axle assembly retention mechanism of the present invention showing the generally preferred T-shaped embodiment thereof, and which includes a longitudinally disposed shaft, a connecting means disposed at the proximal end for connection to the axle assembly, and showing at the distal end the frame engagement means for connection to the frame, and for supporting the weight of the axle assembly when the frame is elevated above its resting position; and FIG. 4 is a side view of the embodiment of the improved axle assembly retention mechanism of the present invention showing the laminated structural elements thereof.

DETAILED DESCRIPTION OF PREFERRED EMBODIMENTS

The present invention is directed to an axle assembly retention mechanism for use in connection with a railroad truck, and in particular for retaining the wheels and axle of the railroad truck together with the railroad truck frame when the frame is elevated above its resting position.

The improved axle assembly mechanism of the present invention includes a connector means which is disposed at the proximal end of the axle assembly retention mechanism for operative connection with the axle assembly of the railroad truck. The improved axle assembly retention means includes a shaft having a longitudinal dimension and extending upwardly from the connector means. The shaft has a frame articulation means disposed at the distal end of the shaft for operative connection to the frame, and functions for retaining the axle assembly with the frame and elevating the railroad truck axle assembly by means of the railroad truck axle assembly retention mechanism when the frame has been elevated.

At least the shaft of the railroad truck axle assembly is formed from at least two longitudinally disposed laminations.

The improved axle retention assembly of the present invention functions to damp vibrations transmitted from the rail through the railroad truck assembly to the axle assembly retention mechanism, in which would otherwise excite a resonant frequency in a one-piece axle assembly retention mechanism.

The railroad truck axle assembly improvement of the present invention has in preferred embodiments an axle box connection means for connection of the axle box of the railway truck to the axle assembly retention mechanism.

The axle assembly retention mechanism hereof is disposed in preferred embodiments free of contact with the frame.

As to the specific structure of the axle assembly retention mechanism, the longitudinal dimension of the shaft thereof is disposed substantially vertically.

In preferred embodiments, the frame engagement means of the axle assembly retention means includes frame engagement surfaces disposed laterally of the longitudinal dimension of the shaft for operative connection with the frame. Such frame engagement means further may preferably include a pair of lifting force engagement arms which are disposed laterally of the shaft. Such frame engagement surfaces are also in preferred embodiments disposed at the underside of the lifting force engagement arms. In plan view, the axle assembly retention mechanism of the present invention may preferably be generally T-shaped in overall format.

The frame of the railroad axle assembly includes in preferred embodiments projection means which extend laterally of the frame for engagement with the frame articulation means of the axle assembly retention means during elevation of the frame. These projection means may preferably comprise a pair of projections extending laterally from the frame for engaging with the axle assembly retention mechanism during elevation of the frame.

The axle assembly retention mechanism hereof comprises laminations of substantially congruently shaped plates, which are preferably formed of a metallic material, steel materials in particular, which are known to those of ordinary skill in the art. These laminations forming the axle assembly retention mechanism are held together by transversely disposed connectors, preferably in the form of rivets, also of known design and materials.

Referring now to the drawing and to FIGS. 1 and 2 in particular, the axle assembly retention mechanism generally 10 of the present invention is intended for use in connection with a railroad truck generally 12, and in particular for retaining the wheels 14 and axle 16 of railroad truck 12 together with the railroad truck frame 18 when frame 18 is elevated above the resting position, as shown particularly in FIG. 1.

Referring now also to FIG. 3, the improved axle assembly mechanism 10 of the present invention includes a connector means in the embodiment of FIG. 3 taking the form of a broad base element 20, which is disposed at the proximal end 22 of axle assembly retention mechanism 10 for operative connection with the axle assembly generally 24 of railroad truck 12, as shown in FIG. 1 in particular.

The improved axle assembly retention means 10 includes a shaft 26 having a longitudinal dimension 27 and extending upwardly from base element 20. Shaft 26 has a frame articulation element 28 disposed at the distal end 30 of shaft 26 for operative connection to frame 18 (see FIGS. 1 and 2), and functions for retaining the axle assembly 24 together with frame 18 when frame 18 has been elevated.

As shown particularly in FIG. 4, the body 32 of railroad truck axle retention means 10 is formed from a plurality of longitudinally disposed laminations 34*a–d*.

Railroad truck axle retention mechanism 10 of the present invention is shown connected to axle box 36 by means of axle box bolts 38 disposed within base portion 20. The axle assembly retention mechanism 10 hereof is disposed as shown in these preferred embodiments free of contact with frame 18.

As to the specific structure of axle assembly retention mechanism 10 and as best shown in FIG. 2, the longitudinal dimension 27 of shaft 26 thereof is disposed substantially vertically.

As shown in FIG. 3, frame engagement element 28 of axle assembly retention mechanism 10 includes frame engagement surfaces 39,39 disposed laterally of the longitudinal dimension 27 of shaft 26 for operative connection with frame 18, as shown in FIG. 2. Such frame engagement element 28 includes a pair of lifting force engagement arms 40,40 which are disposed laterally of shaft 26. Frame engagement surfaces 39,39 are disposed at the underside of lifting force engagement arms 40,40. Hence, as shown in FIGS. 1 and 3, axle assembly retention mechanism 10 of the present invention is generally T-shaped in overall format, although other shapes as may function substantially in the indicated manner are contemplated.

As shown in FIGS. 1 and 2, frame 18 of railroad truck assembly 12 includes projections 42,42 which extend laterally of frame 18 for engagement with frame engagement surfaces 39,39 during elevation of frame 18. These paired projections 42,42 extend laterally from frame 18 for engaging with axle assembly retention mechanism 10 during elevation of frame 18, such as for example may occur during maintenance operations.

As shown in FIG. 4, axle assembly retention mechanism 10 hereof comprises laminations 34*a–d* of substantially congruently shaped plates 44*a–d*, which are preferably formed of a metallic material. Laminations 34*a–d* forming the axle assembly retention mechanism 10 are held securely together by a plurality of spaced and transversely disposed connectors, preferably in the form of rivets 46, although bolts or other connector means could be used.

As to specific materials, the particular types of steel and other metals from which the axle assembly retention mechanism, rivets and other components hereof may be made are known to those of ordinary skill in the art, and accordingly need not be set forth herein in detail.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. In a railway truck axle assembly retention mechanism for retaining a railway truck axle assembly, including rail wheels and an axle, together with a railway truck frame, when said frame is elevated for maintenance purposes, said axle assembly retention mechanism including connector means connected at its lower end to an axlebox and having engagement means at its upper end for engaging portions of said frame when said frame is lifted whereby upon lifting of said frame, said frame will lift said connector means which in turn will lift said axlebox, said connector means being formed of a plurality of flat metal plates arranged in face-to-face relation and secured to one another, whereby engagement of said plates against one another in face-to-face relation will effect damping of vibrations when said railway truck axle is operating on rails at which time said upper end of said connector means is disengaged from said frame.

2. The invention defined in claim 1, where said flat metal plates are made of steel.

3. The invention defined in claim 1 where attachment means are utilized to permanently attach said metal plates together.

4. The invention of claim 3 where said attachment means comprises rivets.

5. The invention of claim 1 where said connector means comprises at least three said flat metal plates fastened together in face-to-face relation.

6. The invention of claim 1 where said connector means comprises at least four said flat metal plates fastened together in face-to-face relation.

7. In a railway truck axle assembly retention mechanism for retaining a railway truck axle assembly, including rail wheels and an axle, together with a railway truck frame, when said frame is elevated for maintenance purposes, said axle assembly retention mechanism including connector means connected at its lower end to an axlebox and having engagement means at its upper end for engaging portions of said frame when said frame is lifted whereby upon lifting said frame, said frame will lift said connector means which in turn will lift said axlebox, said connector means being formed of at least three flat metal plates secured together in face-to-face relation and secured to one another, whereby engagement of said plates against one another in face-to-face relation will effect damping of vibrations when said railway truck axle is operating on rails at which time said upper end of said connector means is disengaged from said frame.

8. The invention of claim 7 where said flat metal plates are permanently secured together in face-to-face relation.

9. The invention of claim 8 where said connector means comprises four said flat metal plates permanently secured together in face-to-face relation.

10. The invention of claim 9 where said four flat metal plates are secured together by a plurality of rivets.

* * * * *